United States Patent [19]

Dabringhaus et al.

[11] 4,343,422

[45] Aug. 10, 1982

[54] APPARATUS FOR DEFLECTING A MOVING WEB OF MATERIAL

[75] Inventors: Wilfried Dabringhaus; Helmut Glotzbach; Karl Voss, all of Leverkusen, Fed. Rep. of Germany

[73] Assignee: Agfa-Gevaert Aktiengesellschaft, Leverkusen, Fed. Rep. of Germany

[21] Appl. No.: 209,383

[22] Filed: Nov. 24, 1980

[30] Foreign Application Priority Data

Nov. 30, 1979 [DE] Fed. Rep. of Germany ..... 2948290

[51] Int. Cl.[3] ..... B65H 23/32

[52] U.S. Cl. ..... 226/197; 226/97; 226/170

[58] Field of Search ..... 226/170, 171, 172, 197, 226/95, 97, 15, 16, 17, 18, 19, 20, 21, 22, 23

[56] References Cited

U.S. PATENT DOCUMENTS

| | | | |
|---|---|---|---|
| 3,125,268 | 3/1964 | Bartholomay | 226/197 X |
| 3,206,089 | 9/1965 | Huck | 226/197 |
| 3,368,729 | 2/1968 | Connelly | 226/197 |
| 3,679,116 | 7/1972 | Hamlin | 226/197 |
| 3,684,148 | 8/1972 | Upmeier | 226/197 |
| 3,734,487 | 5/1973 | Treff | 226/197 |
| 4,043,495 | 8/1977 | Sander | 226/97 |
| 4,274,608 | 6/1981 | Gilorich | 226/170 |

*Primary Examiner*—Edward J. McCarthy
*Attorney, Agent, or Firm*—Connolly and Hutz

[57] ABSTRACT

The invention relates to an apparatus for deflecting a web of material moving in its longitudinal direction, both into a plane situated at right angles to the surface of the web and into a plane situated in the surface of the web, whereby a supporting element provided for the web during its deflection is an endless flat belt which the web mounts before it is deflected and which the web leaves after its deflection and cylindrical rollers and deflecting bodies in the form of tube and/or tube segments having supporting means on their circumferential surface are provided which guide the endless belt to deflect the web and subsequently return the belt to the point where the web mounts the belt.

12 Claims, 14 Drawing Figures

FIG. 2 (A-A)

APPARATUS FOR DEFLECTING A MOVING WEB OF MATERIAL

This invention relates to an apparatus comprising mechanical means by which a web of material moving in its longitudinal direction is deflected both into a plane perpendicular to the surfaces of the web and within the plane containing these surfaces.

When a web moves in the direction of its longitudinal axis, a change of direction of the web into a plane perpendicular to its surfaces can be brought about by the simplest of mechanical elements such as, for example deflecting rollers. The web encounters the deflecting roller at right angles to the axis of the roller and when it has been deflected by the required angle it leaves the roller, again at right angles to the roller axis. The velocity vectors of points on the web and on the surface of the roller are identical so that no relative movement takes place between the roller and the web. The velocity of any point on the web is equal to the circumferential velocity of the roller and no velocity component exists in the direction of the axis of deflection.

Deflection of the web in a plane of the surfaces of the web cannot be achieved by means of a simple deflecting roller because when a web runs obliquely over the deflecting roller, the velocity vectors of the surface of the roller and of the web do not coincide. Whereas the velocity of moving points on the surface of the roller is a purely circumferential velocity, the velocity of the webs has a component in the axial direction as well as in the circumferential direction. In order to prevent relative displacement between the web and the surface of the roller, the deflecting roller would have to rotate at a circumferential velocity equal to the circumferential velocity component of the web and at the same time it would have to be displaced in the direction of its longitudinal axis at a velocity equal to the axial component of the velocity of the web. This would require a deflecting roller of indefinite width.

Numerous Patents and Patent Applications have disclosed deflecting devices for webs in which the web is deflected about a tube having a large number of bores from which air is discharged to produce an air cushion, and the web is deflected on this air cushion between itself and the tube.

In the U.S. Pat. No. 3,125,268 there is described an apparatus for turning a band, in which the band is conducted over a body having a convex surface to form a twisted path, and the band is kept away from this surface by pressurised air. In U.S. Pat. No. 3,679,116, a web is deflected through 90° or 180° in its plane by passing it over a tube set at an angle of 45° to the direction of travel of the web. The tube has a plurality of apertures from which pressurised air is discharged to produce an air cushion between the web and the tube.

Although these air cushion elements are very simple and inexpensive in manufacture, they have serious disadvantages. Apart from a considerable consumption of pressurized air and hence of energy for their production zones of low pressure are produced at the edges of the web due to the lateral discharge of air at a high velocity from a relatively narrow gap, with the result that the web is drawn towards the air cushion element and is liable to touch it and then to be repelled from it, so that it begins to flutter. The edge of the web is liable to be damaged by this fluttering or to suffer abrasion.

For webs running along an exact path, this effect [Bernoulli effect] has been compensated for by various measures.

In U.S. Pat. No. 3,567,093, the deflecting surface is subdivided into chambers with side plates. In British Pat. No. 1,307,695, this problem is solved by the injection of compressed air in the tangential direction on both sides, both at the entrance and at the exist of the webs from the deflecting device. These measures, however, are ineffective in the event of lateral displacements of the web resulting from disturbances in the preceding or subsequent path of the web. Fluttering also occurs if the web is slightly winged. If the edge of the web tears, the pressure in the air cushion breaks down. The air flow in these pneumatic deflecting devices must be very uniform, but uniform air distribution over the whole width of the web and correction of the path of the web in the event of disturbances have not been reliably solved to this day in spite of a large number of Patent Applications.

Mechanical deflection devices are also known for deflecting a web within its plane. These devices are particularly distinguished by the fact that they require no energy in the form of pressurized air. Webs which are not delicate, e.g. paper webs, are deflected by being passed over an obliquely placed tube. The axial velocity component is compensated for by slipping the web along the tube, although this rubs and scratches the surface of the web and produces dust by abrasion.

According to U.S. Pat. No. 3,368,729, the web is deflected over an obliquely placed bar by providing rollers which are so arranged that the axial velocity component of the web can also be taken up. Deflection of the web through 90° is carried out in two stages of 45° each. Since the velocity of points on lines of the rollers do not coincide with points on the web, a relative displacement occurs between the rollers and the web, whereby friction is produced. This apparatus is unsuitable for webs of delicate material on account of the number and shape of the rollers which press into the web scratch and graze the back of the web.

German Auslegeschrift No. 2,032,065 discloses a turning apparatus for flexible webs which is based on the principle of subdividing the velocity of the web into a circumferential component and an axial component. The distance which has to be observed between the rollers for constructional reasons is too great for delicate webs [foils, films] so that this apparatus also produces too high a specific load on the surface of the web.

The close spacing of the rollers illustrated cannot be realised in practice since mounting means would have to be provided for mounting the rollers on a curved axis and a method of freely mounting the rollers would require a support when the usual tensions in the web occur. Due to the radial arrangement of the rollers, velocity differences between the web and the rollers occur when the web runs obliquely over the rollers. If, as proposed, hollow bodies in the form of flexible tubes which turn about a curved axis are used, the outer surface is always wider than the inner surface so that the tube is subjected to tension and compression in the longitudinal direction with each rotation. Relative displacement therefore again occurs between the rotating body and the web, so that friction is produced. This apparatus is therefore also unsuitable for thin webs with delicate surfaces.

It is an object of the present invention to provide a deflecting device for webs of material which can be used for deflecting webs with very delicate surfaces in any required direction without damaging the cast surface and/or back surface of the web and which is reliable and energy saving in operation and requires little or no servicing.

To solve this problem according to the invention the device used for supporting the web during its deflection is an endless flat belt on to which the web runs at a uniform velocity before its deflection and which it leaves after its deflection, and cylindrical rollers and deflecting bodies in the form of tubes and/or segments of tubes having supporting rollers on their circumference are provided, which guide the endless flat belt to deflect the web and subsequently return the belt to the starting point where the web runs on to the belt.

It was surprising to the man in the art to find that this apparatus can be used to deflect a wide web of material in any desired manner, including even delicate material such as, for example, a web carrying highly sensitive photographic emulsions, without the slightest damage to the surface of the web. The web runs on to the flat belt at a uniform velocity and makes complete surface contact with the belt during the whole deflecting process without any relative displacement between the web and the belt. The belt is normally driven by the web which is looped round it. The entire process requires virtually no servicing and is reliable in operation. It requires no additional quantities of energy of the order used for deflection on an air cushion.

According to a particular embodiment of the invention a multiple spline flat belts, i.e. a belt which has a plurality of wedge grooves on its undersurface, may be used instead of the plane flat belt. In that case, the cylindrical rollers have external profiles conforming to the grooves of the belt. The rollers on the circumference of the deflecting elements also have profiles adapted to the grooves on the belt.

These multiple grooves provide positive guidance for the flat belt so that it does not need to be controlled or regulated.

The apparatus is distinguished by the fact that the mechanical means for deflecting the belt and hence the web carried on it consists of cylindrical rollers for deflecting angles of $\alpha=90°$ and tubes or segments of tubes for deflecting angles of $\alpha\neq 90°$, with supporting rollers arranged on the peripheral surface.

If the flat belt runs at right angles on to and off the roller [$\alpha=90°$], ordinary cylindrical rollers may be used or, in the case of multi spline belts; cylindrical rollers which have the appropriate profile for the wedge grooves of the belt on their surface. If, on the other hand, the belt runs on to the roller at an angle $\alpha\neq 90°$, the deflecting elements used are tubular bodies having a plurality of supporting rollers on their surface, at least in the region over which the supporting belt runs. If the belt is only required to embrace the deflecting body over an angle of 90° or 180°, it is sufficient to provide a segment of a tube instead of a complete tubular body for deflection, so that another tubular segment may be placed inside the first for returning the belt, and a space saving arrangement can thus be obtained.

A particularly suitable method of guiding the supporting belt consists of equipping the tubular or segmental deflecting bodies with supporting rollers whose supporting surface has an elliptical curvature with major axes $a=(r/\cos\alpha)$ and $b=r$, where r is the radius of the deflecting body and $\alpha$ the angle at which the belt encounters the deflecting body.

Supporting rollers of this form provide ideal conditions of travel for the supporting belt over the circumverence of the deflecting element. The velocity of the moving points on the belt always coincides with the velocity of the supporting surfaces of the rollers.

Supporting rollers which are inexpensive and simple to manufacture are obtained by giving them a supporting surface having an average radius close to that of elliptical rollers. The velocity error between the web and the rollers can easily be kept below 1% by suitable choice of the width of the supporting rollers, so that the error is negligible in practice.

An apparatus for web deflection which is independent of the angle of encounter $\alpha$ of the supporting belt and the web consists of deflecting bodies in the form of tubes or tube segments which have ball cages on their circumferential surfaces, with balls rotatably mounted in said cages so that the endless flat belt is deflected by rolling over these balls, and the flat belt is so constructed and the number of balls so chosen that the surface of the flat belt undergoes no deformation when deflected and the belt does not touch the deflecting body.

A particularly smooth run of belt for deflecting a web is obtained when the tubular or segmental deflecting body is constructed as a pressure vessel with a connection for compressed air and the ball cages have apertures opening into the interior of the pressure vessel, and the balls in their cages seal off the internal space and turn on an air cushion inside the cages when the belt runs over them.

In one particularly advantageous embodiment of the apparatus, one of the cylindrical deflecting rollers of the deflecting apparatus is provided with drive means for driving the belt and hence the web. This arrangement obviates the necessity for any other drive means for the web.

If any external influence interfere with the movement of the supporting belt, causing it to deviate from its described path, the movement of the belt can be corrected, regulated and controlled by equipping the deflecting device with means which enable the axis of the cylindrical deflecting rollers to rotate horizontally about their centre.

Another advantage method for correcting, regulating and controlling the movement of the belt on the deflecting apparatus consists of providing means which enable the deflecting axis of the deflecting bodies to shift in a direction parallel to itself, thereby altering the angle over which the belt is looped round the deflecting body.

In one space saving arrangement of the deflecting apparatus, the deflecting bodies provided for returning the supporting belt are arranged inside the deflecting body provided for the belt with the web on it. In yet another embodiment of the apparatus, the deflecting bodies for returning the belt are arranged in front of the deflecting bodies for deflecting the belt and web.

Other advantages, features and possible applications are described below with reference to the accompanying drawings, in which.

Figure 7:
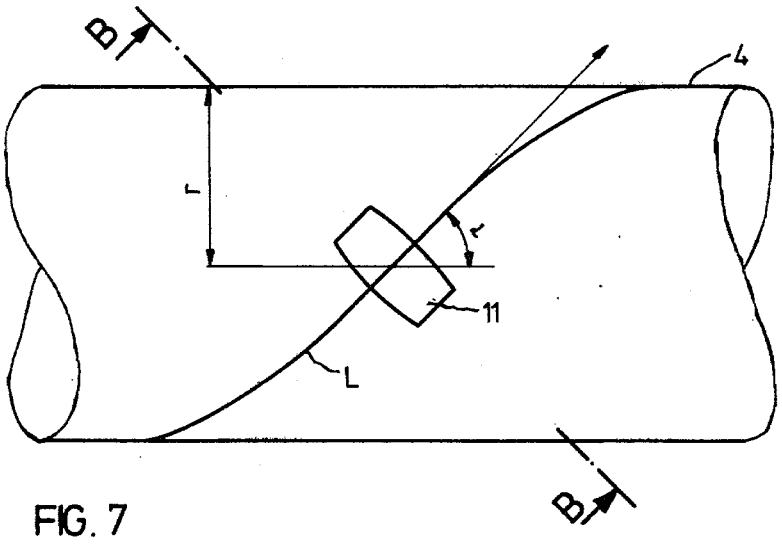
FIG. 7 represent elliptical belt support rollers on the tubular deflecting body.
Figure 7A:
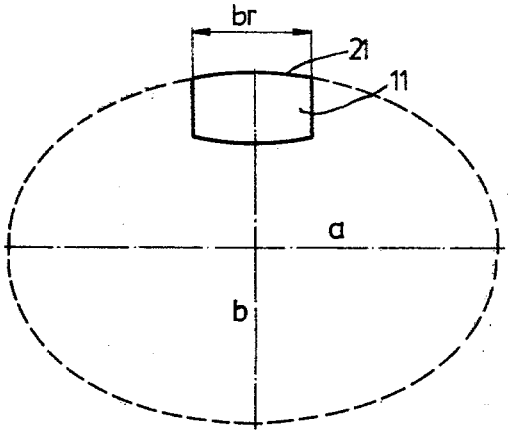
Figure 8:
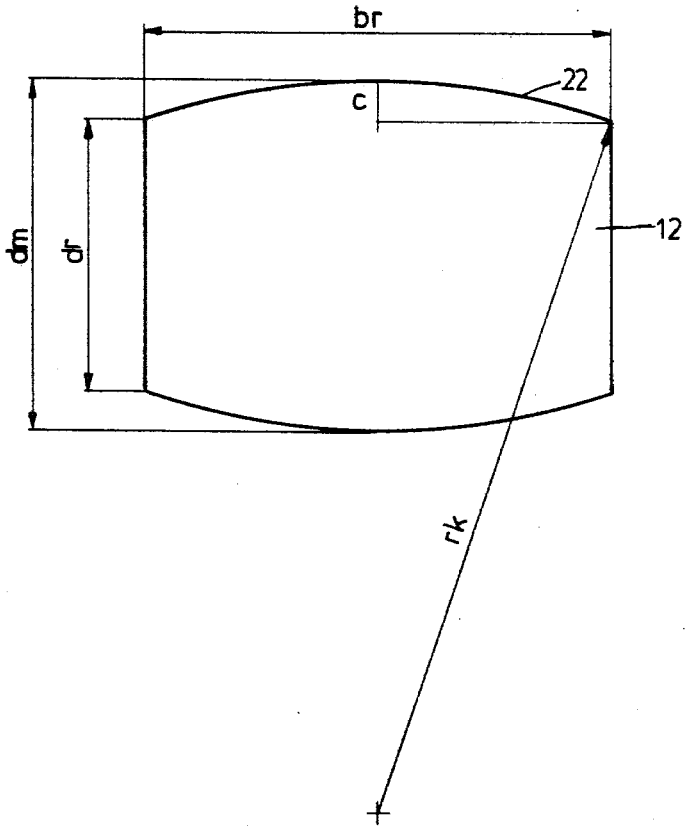
Figure 9:
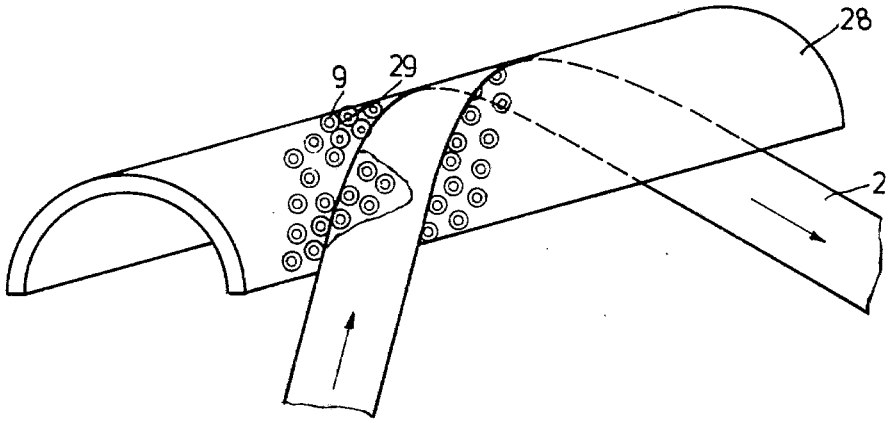
Figure 10:
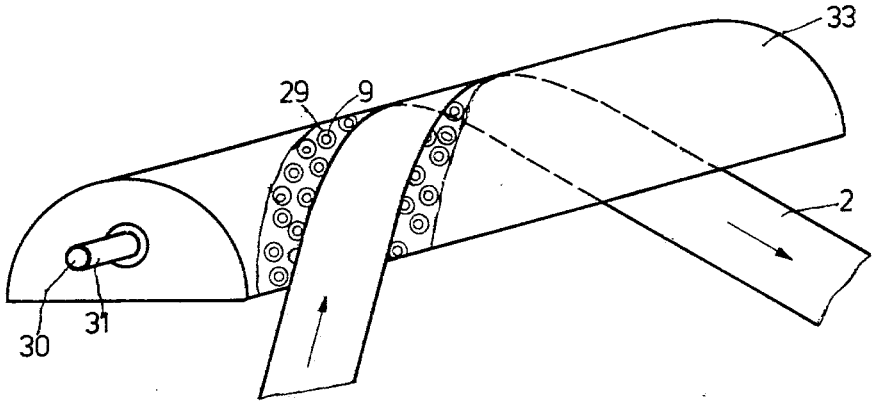
Figure 11:
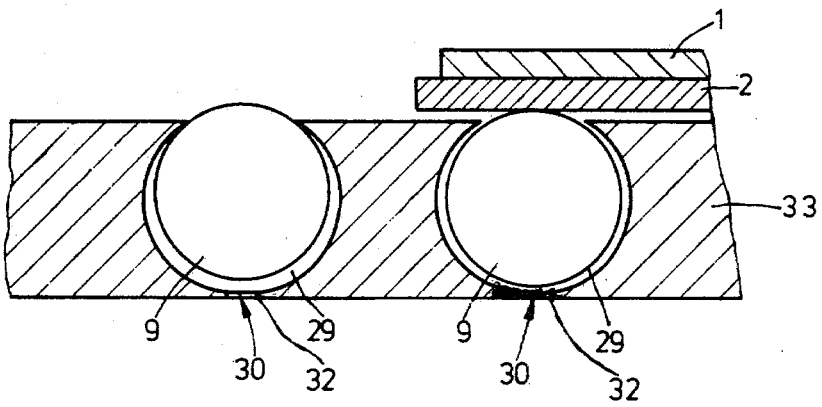

FIG. 7*a* represents the elliptical belt support roller of FIG. 7;

FIG. 8 represents a simplified form of belt supporting rollers;

FIG. 9 represents a deflecting body in the form of a tubular segment with balls for supporting the belt;

FIG. 10 represents a deflecting body in the form of a tubular segment supplied with compressed air and equipped with balls for supporting the belt; and FIG. 11 shows a section on an enlarged scale of the wall of the deflecting body equipped with balls and supplied with compressed air.

Figure 1:
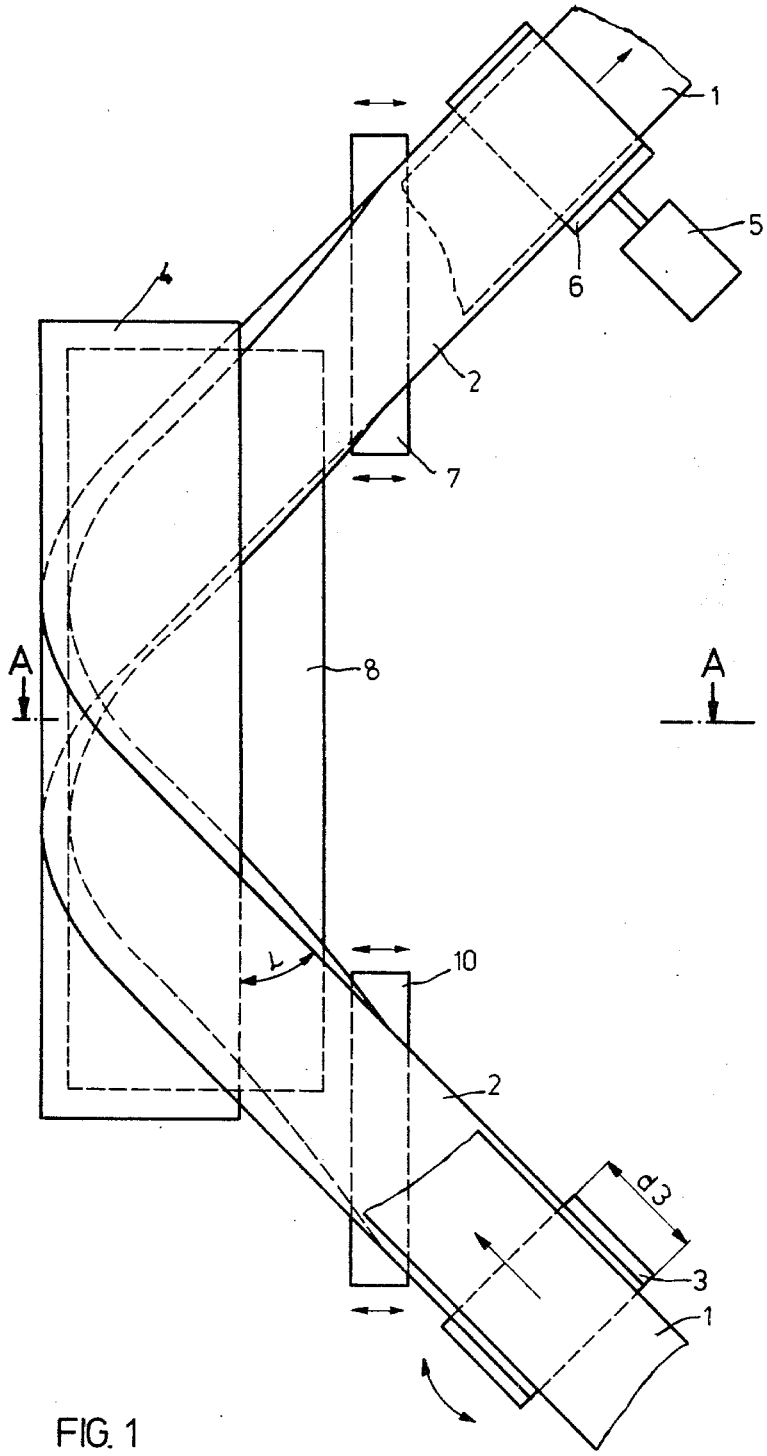
FIG. 1 is a top plan view of a deflecting element for deflecting a web through 90° within the plane of the web.
Figure 12:
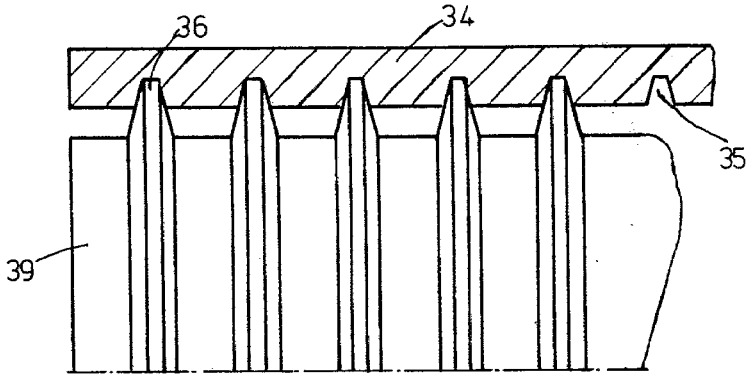
Figure 12A:
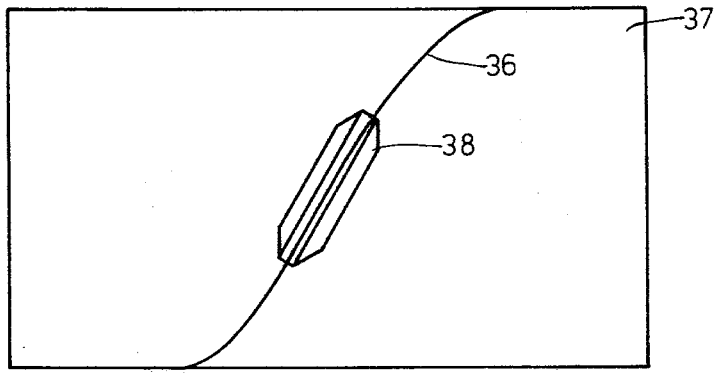

FIG. 12 represents a cylindrical deflecting roller for a splined belt;

FIG. 12*a* represents a deflecting body with one of a plurality of rollers;

FIG. 1 represents an exemplary embodiment illustrating a main feature of the deflecting element, i.e. a supporting belt 2 which carries a web 1 to deflect it over an actual deflecting body 4 and which is returned in an endless path over other deflecting bodies 6,7,8,10 and 3. The arrangement and geometrical dimensions of all the deflecting bodies are chosen to provide unrestricted movement of the belt. This means that all the moving points of the belt 2 have the same velocity parallel to the longitudinal axis of the belt 2 during the entire passage of the belt through the deflecting apparatus.

The endless belt runs over a cylindrical deflecting roller 3 to receive the web 1 into the deflecting device at an angle $\alpha$. The web 1 is fed to it at the same angle $\alpha$, e.g. [as shown in FIG. 1] at an entry angle $\alpha=45°$. The web 1 mounts the supporting belt 2 on the deflecting body 4 which is in the form of a half tube serving as supporting body for a plurality of rollers 11, 12 or balls 9, and the web is deflected while lying on this belt 2 and leaves the belt 2 after having been deflected by body 4. The web has now been turned over, i.e. its upper surface is now its under surface, and its path has been deflected in its own plane by $2\alpha=90°$.

The belt runs at right angles over the second cylindrical deflecting roller 6 to mount deflecting body 7 having the form of a tube segment and travels from there over tubular deflecting body 8 and then over deflecting body 10 in the form of a tube segment to return to the cylindrical deflecting body 3.

Figure 2:
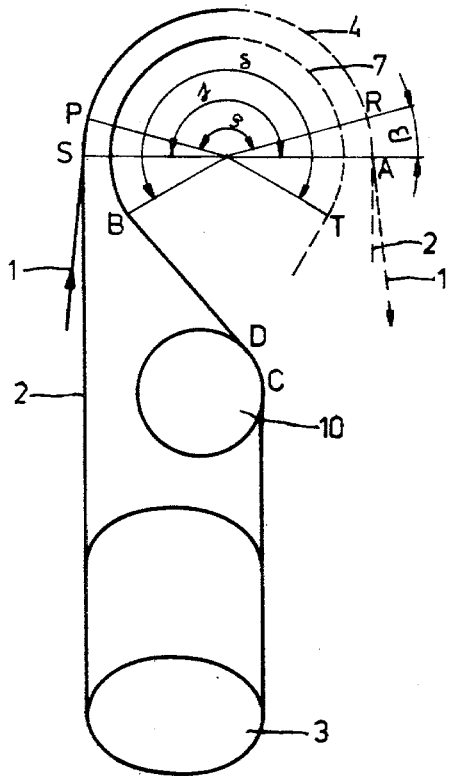
FIG. 2 is a schematic side view taken on the line A—A of the deflecting element of FIG. 1.

FIG. 2 shows the deflecting device of FIG. 1 in a section A—A through the axis of symmetry of the deflecting device. The web 1 mounts the belt 2 at a point P and leaves it at point R. Every point on the web 1 describes an angle $\rho$ between P and R and is shifted forward towards the observer by an amount depending on the diameter of the segmented deflecting body 4 and on the angle of incidence $\alpha$. If $\alpha$ were 90°, the points P and R would lie in the plane of the drawing of FIG. 2 and the web could be deflected over a normal cylindrical roller.

In order to ensure that the web 1 mounts and leaves the supporting belt 2 at specific points, the looping and $\rho$ of the belt 2 on the segmental tubular deflecting body 4 may be chosen to be greater by $2\beta$ than the looping angle $\rho$ of the web 1 so that $\gamma=\rho+2\beta$. The supporting belt 2 then mounts the deflecting body 4 at a point S in FIG. 2 and leaves the supporting belt 2 at a point A. The belt 2 and the web 1 travel at the same angle $\alpha$ over the deflecting body 4 so that during the velocity vectors of moving points on them are identical so that no relative displacement between the web 1 and belt 2, which could cause damage such as scratching, abrasion creasing or the like, occurs.

After the web 1 has left the belt 2 at the point R, the belt [as shown in FIG. 1] travels over a cylindrical deflecting roller 6 and a deflecting body 7 to mount the inner deflecting body 7 inside the outer deflecting body 4 at point T at an angle $\alpha$. After travelling over the deflecting body 7 through a looping angle $\sigma$ the belt 3 leaves the body 7 at point B and mounts the deflecting body 10 at point D, leaving the body 10 at the point C after running over it for a small angle to reach the cylindrical deflecting roller 3.

Figure 3:
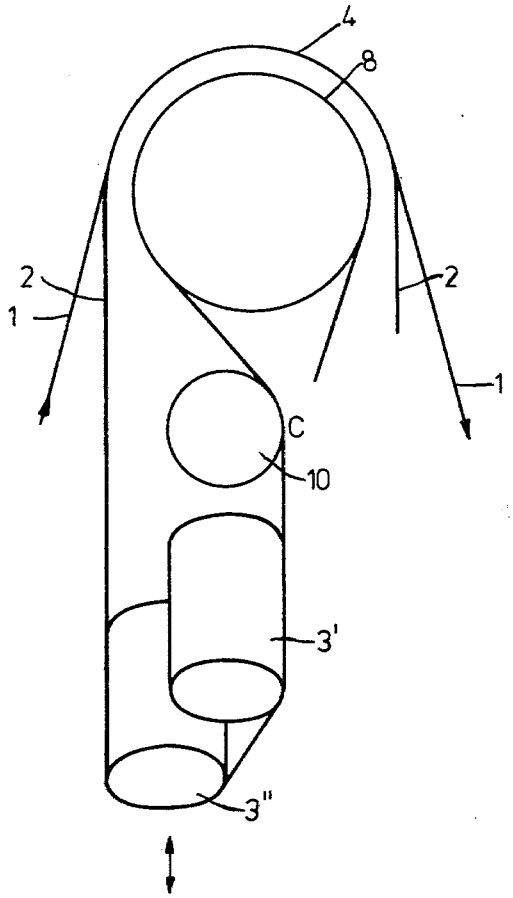
FIG. 3 is a schematic side view of another embodiment of the deflecting element of FIG. 1.

FIG. 3 shows a particular embodiment in which the cylindrical deflecting roller has been replaced by two or more deflecting rollers 3′ and 3″ [3‴] and the belt leaves the deflecting element 10 at point C to mount the first cylindrical deflecting roller 3′ at an angle of 90°. If the belt 2 mounts the deflecting rollers 3, 3′, 3″ at right angles, the velocity in the direction of the axis of the deflecting roller is zero, and normal cylindrical rollers may therefore be used.

By replacing the one cylindrical deflecting roller 3 by two or more rollers 3′, 3″ . . . , it is possible to use rollers of smaller diameter instead of one roller with a large diameter. In addition the deflecting rollers 3′,3″ may be used to provide a tensioning device for the endless belt by displacing one of the rollers 3′, 3″ parallel to the plane in which the belt is travelling [see arrow at 3″, FIG. 3].

Figure 4:
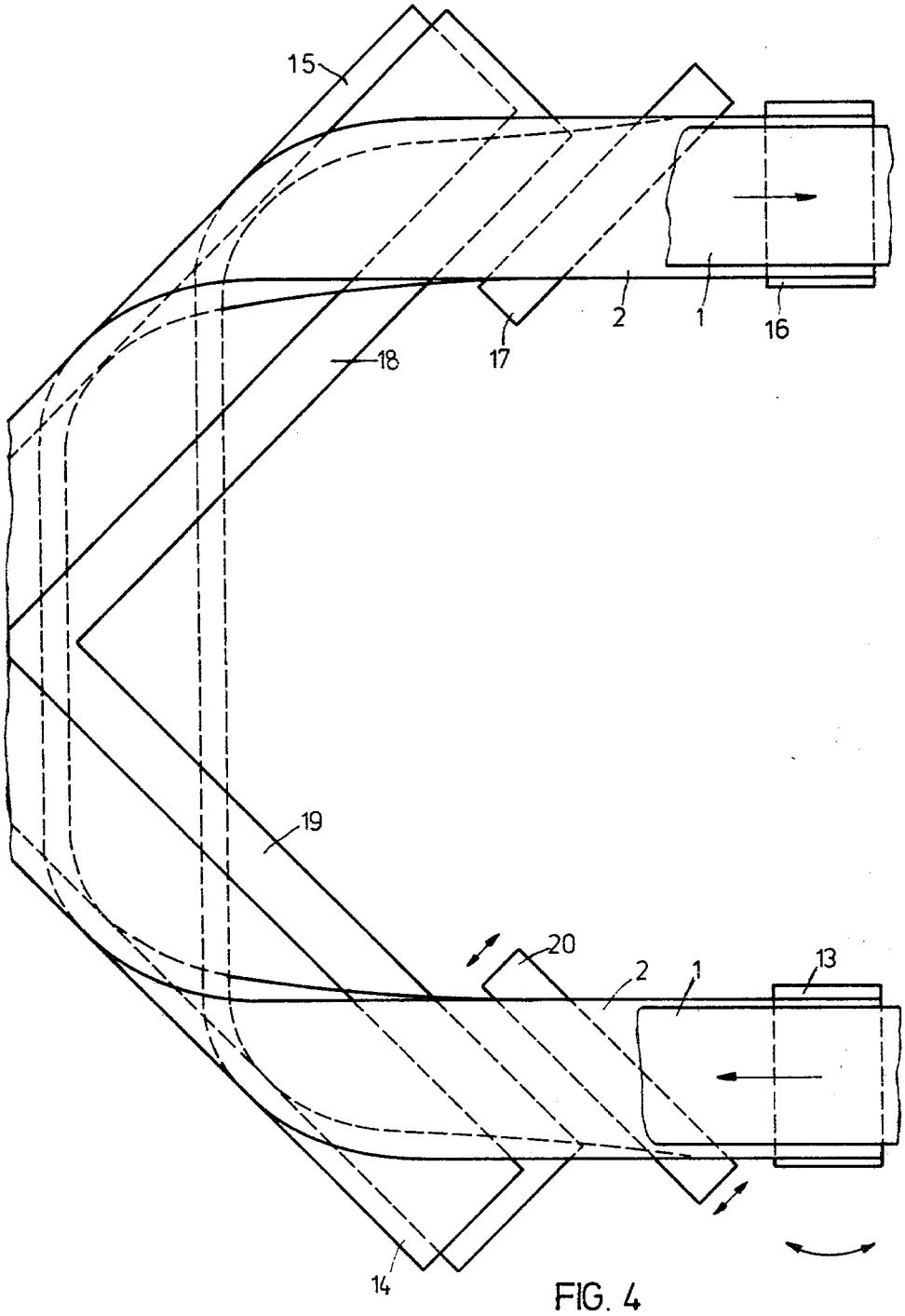
FIG. 4 is a top plan view of a deflecting element for deflecting a web through 180° within the plane of the web.
Figure 5:
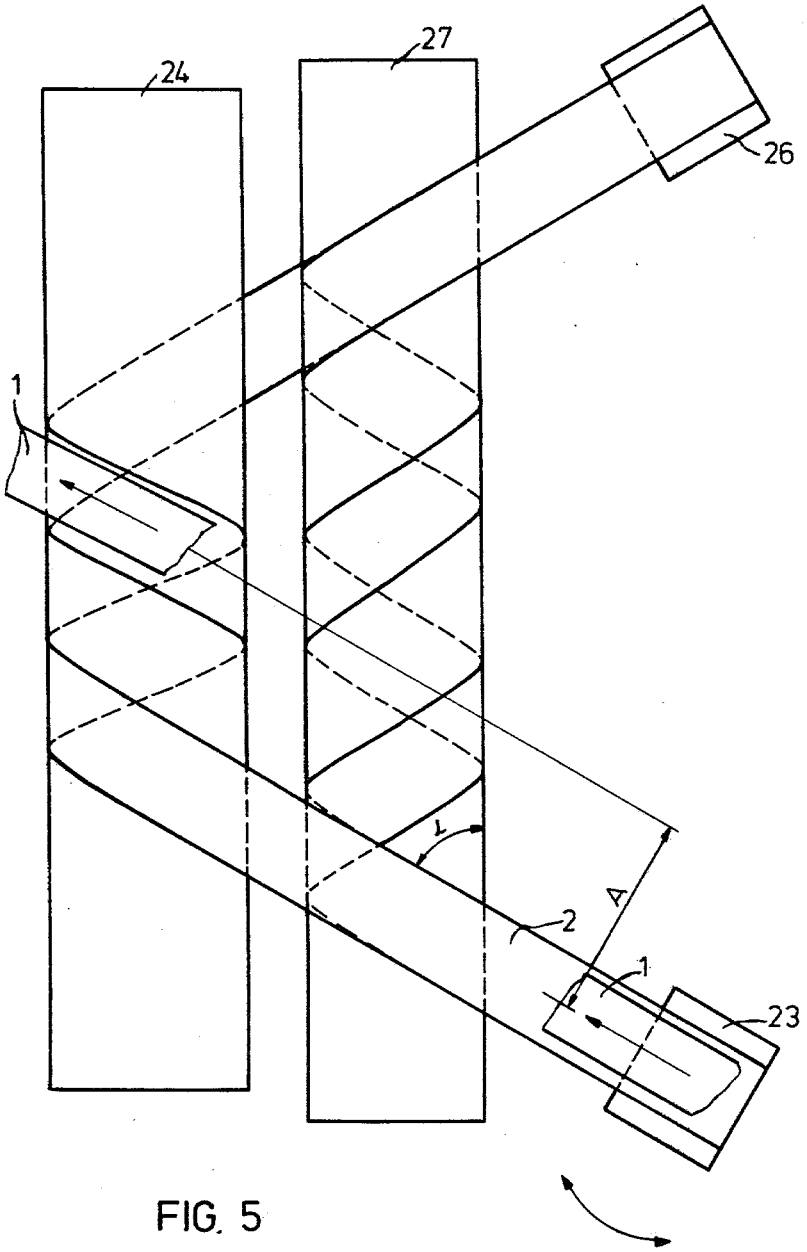
FIG. 5 is a top plan view of a deflecting element for laterally shifting a web through a distance A.

This arrangement is also applicable with suitable adjustment to other deflecting devices in which the web is deflected through 180° or parallel to its direction of travel or in some other manner, for example as illustrated in FIGS. 4 and 5.

FIG. 4 illustrates a deflecting device in which the web 1 is deflected through 180° in its plane. The belt 2 leaves the cylindrical deflecting roller 13 and the web 1 mounts the belt 2 on a deflecting body 14, and while lying on the belt 2 it is deflected twice through 90° by deflecting bodies 14 and 15, and it leaves the belt 2 after having been deflected on the deflecting body 15. The belt 2 is passed over the cylindrical deflecting roller 16 to a deflecting body 17 and then over additional deflecting bodies 18, 19 and 20 to be returned to the cylindrical deflecting roller 13. This apparatus is suitable for taking a web off a roll and passing it through two treatment stations side by side to return it to the roll so that, for example, the arrangement for rolling up the web 1 and the arrangement for rolling it off may be placed side by side. There may, of course, be provided a plurality of such arrangements for deflecting the web 1 any number of times.

FIG. 5 shows a deflecting device in which the web 1 is carried forwards after having been shifted by a distance A from its path. The supporting belt 2 leaves a cylindrical deflecting roller 23 and mounts a deflecting body 24 at an angle $\alpha$. The web 1 mounts the belt 2 and is deflected on it through 360° and in addition, by the time it leaves the belt 2 it has been shifted in a direction parallel to its line of travel by a distance A. The belt leaves the deflecting body 24 after looping through 180° once more and is taken to a cylindrical deflecting roller 26 to be deflected and is then looped several times round a deflecting body 27 situated in front of the deflecting body 24 to be returned to the deflecting roller 23.

The arrangement of the deflecting body 27 in front of the deflecting body 24 may, of course, also be employed in the arrangements of FIGS. 1,3 and 4 described above if there is a demand for it. In FIGS. 1, 3 and 4, the deflecting body for returning the belt 2 is situated inside the deflecting body on which the belt 2 is deflected together with the web 1, so that the amount of space required is reduced.

The arrangement illustrated in FIG. 1 is suitable for deflecting a web through an angle of up to 90°, that shown in FIG. 4 is suitable for a deflection of up to 180° and that of FIG. 5 is suitable for an angle of up to 360°. The deflecting device according to the invention are capable of deflecting a web travelling parallel to its longitudinal axis through any desired angle in a plane parallel to the surfaces of the web, the angle of deflection obtained depending on the arrangement and design of the deflecting bodies and rollers.

The supporting belt 2 travels over the cylindrical deflecting rollers 3, 3', 3'',6,13,16,23,26 at right angles [$\alpha=90°$] to the axis of deflection. Its velocity component in the direction of the axis is thus zero and cylindrical rotating bodies may therefore be used as deflecting elements.

Figure 6:
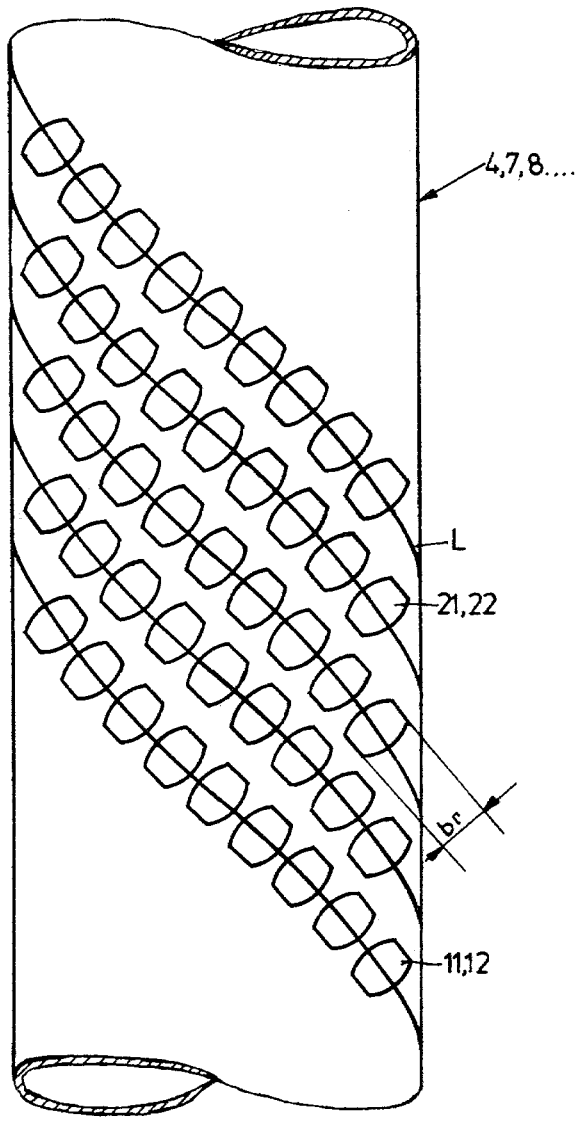
FIG. 6 represents a tubular deflecting body.

The belt 2 runs over the other deflecting bodies shown in the figures at an angle $\alpha\neq 90°$, so that the velocity of the belt has an axial component in addition to the circumferential component. The deflecting bodies 4,7, 8, 10, 14, 15, 17, 18, 19, 20, 24, and 27 are therefore provided with a plurality of supporting rollers 11, 12 or balls 9 mounted on their surface. When supporting rollers 11, 12 are used, the axis of these rollers 11, 12 are placed perpendicularly to the direction of travel L of the belt. Such an arrangement is shown in FIG. 6. A plurality of rollers 11, 12 having elliptical or approximately elliptical tread surfaces 21, 22 are arranged on the peripheral surface of the deflecting body, with their axes perpendicular to the direction of travel of the belt 2. The width b of these rollers is chosen so that any inaccuracy in manufacture will be so small that it will not affect the movement of the belt 2 on the rollers 11,12. The rollers are mounted on the circumference of a deflecting body which is either tubular or in the form of a tube segment. By this is meant that the deflecting body may consist of a segment of a tube, e.g. a half tube if only half the circumference of the tube is required for the deflection. It is also advantageous to restrict the rollers 11,12 to those parts and regions of the circumference of the deflecting body over which the belts runs.

FIG. 7 shows a single supporting roller 11 on the circumference of the tubular deflecting body 4. The roller is placed with its axis perpendicular to the direction of travel L of the belt 2 over the deflecting body 4 at an angle $\alpha$.

If such a device for steering the movement of the belt is cut perpendicularly to the direction of travel of the belt [FIG. 7, section BB], an ellipse with major axes $\alpha=(r/\cos)$ and $b=r$ is obtained, where r is the radius of the tubular or segmental deflecting body 4 and $\alpha$ is the angle of incidence of the belt 2 on the deflecting body 4 as shown in FIG. 7. The surface 21 of the supporting rollers 11 must have the curvature of an ellipse if it is to coincide with the curvature of the ideal belt 2 and hence with the web 1. Since this will in practice entail manufacturing problems and hence extra cost, the supporting rollers 12 may also be constructed with an average radius of curvature $r_K$ as shown in FIG. 8 because the error which then occurs if the rollers are not too wide is very small. If the rollers 12 have a cambered supporting surface 22, velocity differences occurs across the width $b_r$ of the roller, which give rise to a relative displacement between the roller surface 22 and the belt 2. The width $b_r$ of the supporting rollers 12 is limited in order to keep this velocity difference small. The differences in velocity between the centre C of the roller and the edge can easily be kept below 1% so that, as experiments have shown, this error can in practice be kept very small and of no influence.

FIG. 9 shows a deflecting body 28 in the form of a tube or tube segment whose construction is independent of the angle of incidence $\alpha$. Instead of supporting rollers 11,12 a plurality of ball cages 29 containing freely rotatable balls 9 is arranged on the surface of the deflecting body. The balls 9 rotate in the direction of travel of the belt 2 so that the belt is deflected as it rolls over the balls 9. This arrangement takes into account both the circumferential component and the axial component of the movement of the belt 2 without slippage of the belt 2 on the tubular deflecting body 28. The number of ball cages 29 with balls 9 and the stiffness of the belt 2 are calculated so that the belt 2 does not come into contact with the deflecting body 28 but is carried by the balls 9 and shows no surface irregularity where the web 1 lies on it to be deflected.

The belt 2 runs particularly easily on the balls 9 if the balls in their cages 29 roll on an air cushion. FIG. 10 shows a deflecting device in which the tubular deflecting body is a pressure vessel 33 containing, for example, compressed air. The ball cages 29 are connected to the pressure vessel 33 by bores 32 [FIG. 11]. The balls 9 normally seal the pressure vessel 33 off from the outside. When a belt 2 is passed over the balls 9, the balls are pushed inwards against the pressure in the vessel 33 and surrounded by compressed air 30 so that the balls 9 can rotate with little friction on an air cushion and deflect the belt 2 and the web 1 on this belt at any angle of incidence $\alpha$. The deflecting bodies 28,33 may be equipped with balls 9 either over their whole surface or only in the region of the belt, together with a certain margin for the movement of the belt.

If the web 1 is liable to shift slightly on the belt 2 due to external influences, the deflecting apparatus may be provided with devices for controlling the movement of the belt or regulating it fully automatically. One possible arrangement consists of horizontally rotating the axis of one of the cylindrical deflecting rollers 3, 3', 3'', 13, 23 so that the belt 2 shifts sideways on the cylindrical roller until the angle at which the belt 2 mounts the roller is a right angle to the axis. Such controlling and regulating devices are well known in the art of belt drives and therefore require no detailed description here. Such rotation of the axis is indicated by a double arrow at the roller 3 of FIG. 1.

Another method of controlling or regulating the movement of the belt consists of shifting the axis of deflection of the deflecting bodies 10, 20 and 27 to a new position parallel to the original position thereby to change the angle of incidence $\alpha$ to the deflecting body from 8, 19, 24 to 10, 20 27. Such a shift of the deflecting body is indicated by double arrows, for example in the case of deflecting body 10 in FIG. 1 or deflecting body 20 in FIG. 4.

As shown in FIG. 1, each of the deflecting devices may also be used for driving and transporting the web which is required to be deflected, so that no additional driving element is required.

In FIG. 1, the cylindrical deflecting roller 6 is connected by a shaft to a motor 5, e.g. an electric motor with transmission and clutch, which drives the endless belt 2 and with it the web 1. This arrangement may, of course, be provided in all the deflecting devices, e.g. the roller 16 in FIG. 4 and the roller 26 in FIG. 5 may be provided with drive means.

In all the deflecting devices for webs 1 described above, the web 1 runs on to a flat belt 2 and is deflected on it, but instead of the flat belt 2 there may also be used a belt 34 which is flat on its upper surface but is provided on its under surface with a plurality of grooves 35. Such a belt is known as splined belt 34 [FIG. 12]. In such a case, the cylindrical deflecting rollers 39 are provided with raised profiles 36 designed to engage in the grooves 35 of the splined belt 34. The surfaces of the deflecting bodies, FIG. 12A, 37 are provided with a plurality of rollers 38 which also have a profile 36 on their circumference designed to fit into the groove 35 of the splined belt 34. A flat splined belt 34 of this type does not require any adjustment since it is positively guided and therefore does not deviate from its path. Flat splined belts 34 are subject to greater wear due to the positive guidance, as well as being expensive to manufacture. In addition, the cylindrical deflecting rollers 39 require more expensive rotating elements when such belts 34 are used. On the other hand, the deflecting device is easier to drive on account of the improved transmission of force of the deflecting rollers 39.

We claim:

1. Apparatus for deflecting a web of material moving in its longitudinal direction by mechanical means both into a plane situated at right angles to the surfaces of the web and into a plane situated in the surface of the web, characterized in that a supporting element provided for the web during its deflection is an endless flat belt which the web mounts before it is deflected and which the web leaves after its deflection and in that cylindrical rollers and deflecting bodies in the form of tubes and/or tube segments having supporting rollers on their circumferential surface are provided, which guide the endless flat belt to deflect the web and subsequently return the belt to the point were the web mounts the belt.

2. Apparatus for the deflection of a web according to claim 1, characterized in that a splined flat belt is used instead of a flat belt as supporting element for the web, which belt has a plurality of wedge-shaped grooves on its undersurface, and in that deflecting rollers and deflecting elements having their external profile adapted to the wedge-shaped grooves of the splined belt are used.

3. Apparatus according to claim 1, characterized in that the mechanical means for deflecting the belt and the web carried on it are cyclindrical rollers for a deflecting angle of $\alpha=90°$ and deflecting bodies in the form of tubes and/or tube segments for deflecting angles $\alpha=90°$, which deflecting bodies have supporting rollers arranged on their circumferential surfaces.

4. Apparatus according to claim 1, characterized in that supporting rollers are provided on the deflecting bodies which are in the form of tubes or tube segments, the supporting surface of which supporting rollers has an elliptical curvature with elliptical major axes of a $=(r/\cos\alpha)$ and $b=r$, where r is the radius of the deflecting body.

5. Apparatus according to claim 1, characterized in that supporting rollers are provided on the deflecting bodies in the form of tubes or tube segments, the supporting surface provided on these supporting rollers for the supporting belt having a curvature with a mean radius approximating that of the elliptical supporting rollers.

6. Apparatus according to claim 1, characterized in that the deflecting bodies in the form of tubes or tube segments have ball cages on their circumferential surface, and balls rotatably mounted in said cages, the endless flat belt rolling over said balls to be deflected, and in that the flat belt is so constructed and the number of balls so chosen that the flat belt undergoes no deformation on its surface when it is deflected and does not make contact with the deflecting bodies.

7. Apparatus according to claim 6, characterized in that the deflecting body in the form of a tube or tube segment is constructed as a pressure box and has a connection for pressurized air and in that the ball cages have bores for communication with the interior of the pressure box, the balls in their cages sealing off the internal cavity and turning on an air cushion in the ball cages when the supporting belt runs over them.

8. Apparatus according to claim 1, characterized in that one of the cylindrical deflecting rollers of the deflecting apparatus is equipped with a drive for driving the belt and hence the web.

9. Apparatus according to claim 1, characterized in that means enabling the axis of the cylindrical deflecting rollers to rotate horizontally about the centre of the rollers are provided for correcting, adjusting and controlling the movements of the belt.

10. Apparatus according to claim 1, characterized in that means enabling the axis of deflection of the deflecting bodies to shift in a direction parallel to itself and thereby enabling the looping angle round the deflecting body to be altered are provided on the deflecting apparatus for the purpose of correction, adjustment and control of the movement of the belt.

11. Apparatus according to claim 1, characterized in that the deflecting bodies for returning the belt are arranged inside the deflecting body for the belt and the web.

12. Apparatus according to claim 1, characterized in that the deflecting bodies for returning the supporting belt are arranged in front of the deflecting bodies for deflecting the belt and the web.

* * * * *